United States Patent [19]

Jackson

[11] 4,134,343

[45] Jan. 16, 1979

[54] STEERING RADIAL AXLE RAILWAY TRUCK

[75] Inventor: Keith L. Jackson, Granite City, Ill.

[73] Assignee: General Steel Industries, Inc., St. Louis, Mo.

[21] Appl. No.: 744,620

[22] Filed: Nov. 24, 1976

Related U.S. Application Data

[63] Continuation-in-part of Ser. No. 726,943, Sep. 27, 1976, abandoned.

[51] Int. Cl.[2] ..... B61F 5/14; B61F 5/16; B61F 5/38; B61H 13/24

[52] U.S. Cl. ..... 105/167; 105/199 R; 105/224.1; 188/43; 188/53; 267/3

[58] Field of Search ..... 105/165, 166, 167, 168, 105/182 R, 199 R, 218 R, 218 A, 224 R, 224 A, 224.1; 188/53, 46, 43; 267/3; 295/34

[56] References Cited

U.S. PATENT DOCUMENTS

| | | | |
|---|---|---|---|
| 986,185 | 3/1911 | Lincoln | 105/165 |
| 1,293,628 | 2/1919 | Coda | 295/34 |
| 1,640,179 | 8/1927 | Buckwalter | 105/182 R |
| 2,197,727 | 4/1940 | Ledwinka | 105/224.1 X |
| 2,258,663 | 10/1941 | Travilla, Jr. et al. | 105/224.1 |
| 2,606,632 | 8/1952 | Schettler | 188/46 X |
| 2,630,883 | 3/1953 | McGowan | 188/46 X |
| 2,883,005 | 4/1959 | Polanin | 188/53 |
| 3,439,630 | 4/1969 | Cope | 105/224 R |
| 3,528,374 | 9/1970 | Wickens | 105/176 X |
| 3,539,170 | 11/1970 | Hamel | 267/3 X |
| 3,857,556 | 12/1974 | Wing | 105/224.1 X |
| 3,884,157 | 5/1975 | Pelabon | 105/182 R X |
| 4,003,316 | 1/1977 | Monselle | 105/167 |
| 4,067,261 | 1/1978 | Scheffel | 105/176 X |
| 4,067,262 | 1/1978 | Scheffel | 105/168 |

FOREIGN PATENT DOCUMENTS

| | | | |
|---|---|---|---|
| 1268174 | 5/1968 | Fed. Rep. of Germany | 105/167 |
| 1431736 | 2/1966 | France | 105/224.1 |
| 307224 | 3/1929 | United Kingdom | 105/224 R |

*Primary Examiner*—Albert J. Makay
*Assistant Examiner*—Howard Beltran
*Attorney, Agent, or Firm*—F. Travers Burgess

[57] ABSTRACT

A radial axle railway truck has a pair of wheel and axle assemblies with profiled wheel treads of greater than conventional conicity to steer the assemblies by means of the differential effect of the inner and outer wheel diameters on curved track, the axle bearings are located inboard of the wheels, and the truck frame side members are correspondingly located inboard of the wheels and there supported on the axle bearings such that longitudinally acting resilient restraint means between the axle bearings and the truck frame resist substantial movements of the axles longitudinally of the truck frame while offering only limited resistance as a couple to steering movements of the axles with respect to the truck frame because of the relatively short transverse moment arm between the longitudinally acting resilient means. The inboard location of the axle bearings permits the use of straight links extending diagonally of the truck and pivotally connected at their ends to the diagonally opposite axle bearings to oppose hunting movements of the wheel and axle assemblies during movement along tangent track and to couple wheel-induced turning movements of the wheel and axle assemblies in opposite directions on curved track so as to avoid interference with their self-steering ability. An equalized tread brake mechanism is provided to compensate automatically for the differences in longitudinal wheel spacing at the opposite sides of the truck on curved track.

22 Claims, 10 Drawing Figures

STEERING RADIAL AXLE RAILWAY TRUCK

REFERENCE TO RELATED APPLICATION

This application is a continuation-in-part of my copending application, Ser. No. 726,943 filed Sept. 27, 1976, now abandoned.

BACKGROUND OF THE INVENTION

1. Field of the Invention

The invention relates to railway rolling stock and consists particularly in a radial axle truck having improved means for steering the axles and damping hunting movements and a brake system compatible with steering movements of the axles.

2. The Prior Art

Radial axle trucks of the prior art have generally been of the outboard bearing type and in most of those in which steering of the individual axles was provided by the differential effect of conically profiled treads on curved track, resistance to longitudinal movements of the axles with respect to the truck frame was provided by longitudinally acting springs between the outboard axle bearings and the outboard side members of the truck frames or outboard truck side frame. With this location of the longitudinally acting springs, springs stiff enough to maintain the axles in relatively fixed positions longitudinally of the truck during movements on tangent track would offer excessive resistance as a couple to turning or yawing movements of the axle for steering on curved track where the truck side frames are widely spaced apart as on standard or broad gauge cars because of the relatively great spacing transversely of the truck of the longitudinally acting springs and the correspondingly long moment arm through which these springs would act as a couple to oppose turning movements of the axle. This problem would of course increase in seriousness in proportion to the track gauge but would undoubtedly be very serious on all gauges including and exceeding the 4 foot 8½ inch gauge which is standard in the United States, Great Britain and most of Western Europe and increasingly serious on broad gauges, such as the 5 foot gauge as used in the U.S.S.R., the 5 foot 3 inch gauge used in Ireland and elsewhere and the 5 foot 6 inch gauge used in Spain and elsewhere.

In such trucks any diagonal links, bars or rods connecting diagonally opposite axle bearings would have to be bent to clear the wheels, thus requiring heavier links than would be required if straight links could be used.

Because of the steering movements of the axles and the consequent variations in longitudinal spacing between the wheels at the respective sides of the truck, in radial axle trucks of the prior art individual brake rigging was commonly provided for the respective axles and was pivotable therewith.

SUMMARY OF THE INVENTION

It has been found that for steering the individual wheel and axle assemblies of railway trucks to maintain them substantially radial of curved track, a higher than conventional wheel tread conicity and low yaw restraint are desirable, but that in the absence of stiff longitudinal restraint on the wheel and axle assemblies, they will exhibit excessive hunting characteristics. It has also been found that good steering characteristics can be provided and axle hunting minimized or eliminated by connecting the diagonally opposite ends of the respective axles by diagonal links which couple steering movements of the wheel and axle assemblies to permit them to turn equally in opposite directions on curved track in accordance with the differential effect of the wheel diameters engaging the inside and outside rail heads, and on tangent track the diagonal links, combined with the longitudinal restraint means between the wheel and axle assemblies and the truck frame, oppose all tendencies of the wheel and axle assemblies to hunt and through their hunting cause objectionable oscillations of the truck about its swivel connection to a supported car body.

It is an object of this invention to provide a railway truck in which yaw constraint for steering on curved track can be held at a low value while maintaining relatively high resistance against longitudinal movements of the individual wheel and axle assemblies.

A further object of the invention is to provide a truck arrangement, of the type in which the steerable wheel and axle assemblies having their axle bearings connected by diagonally extending links, have a clear, unobstructed pathway between the diagonally opposed axle bearings, such that substantially straight and correspondingly light and simple link elements can be used to connect the diagonally opposite axle boxes.

A further object is the provision of a fluid powered brake system operable on all four wheels of a two axle radial truck in which the brake mechanisms on opposite sides of the truck are equalized to each other such that the brake shoes will be equally operative against the respective wheel treads irrespective of differences in longitudinal spacing of the wheels on opposite sides of the truck when the axles are steered during movement around track curves.

I achieve these objectives by locating the axle bearings inboard of the wheels with the end portions of the truck frame side members overlying the axle bearings also inboard of the wheels and there supported thereon. With this arrangement, stiffer springs for resisting longitudinal movements of the axle relative to the frame can be provided than could be provided if the axle bearings and truck frame side members were located outboard of the wheels without substantially increasing yaw resistance, because of the fact that the inboard location of the springs substantially reduces the transverse arm through which the springs on the opposite sides of the truck act as a couple to oppose yaw. Because of the greater longitudinal resistance offered by such stiffer springs, the tendency of the truck frame to slide off the axles during braking would be greatly reduced and the necessity of a longitudinal tie between the truck frame and the center of the wheel and axle assembly, which would be necessary with an outside bearing truck in which the longitudinal resistance springs would have to be softer to accommodate yaw, could be eliminated.

Among the advantages of the application construction is that the diagonal links can extend straight between the axle bearing on the application truck because they do not have to be bent to clear the wheels as they would have to be on an outside bearing truck and the transverse distance between the link connections to the axle bearings is shorter. This advantage is important during braking of the truck because it minimizes the lateral component of the link force tendency to pull the journal boxes together transversely. Further, since the load path is more direct than with an inside bearing truck, the links can be of lighter construction.

A further advantage of this truck arrangement is that because of the yaw stability of the truck frame with respect to the car body under all conditions, no yaw damping means is required between the truck frame and the car body, as a result of which the truck may be of the bolsterless type in which the car body is carried on springs supported directly on the truck frame and yieldable longitudinally and transversely as well as vertically to accommodate swivel and lateral as well as vertical movement of the body on the truck. In conventional bolsterless trucks, because of the absence of a center plate or friction central bearing through which yaw could be damped, extraneous yaw damping means, such as longitudinally disposed hydraulic dampers, had to be provided between the truck frame and the car body.

The application truck is also provided with an improved hydraulic brake system consisting essentially of a pair of brake levers suspended from transverse pivots on the truck frame side members and directly mounting the brake heads and shoes and being connected longitudinally by a hydraulically extendable bottom rod, the hydraulic cylinders on each side being interconnected hydraulically so as to equalize the forces on the brake shoes irrespective of the relative longitudinal spacing of the inside and outside wheels on curved track.

DETAILED DESCRIPTION OF THE INVENTION

Figure 1:
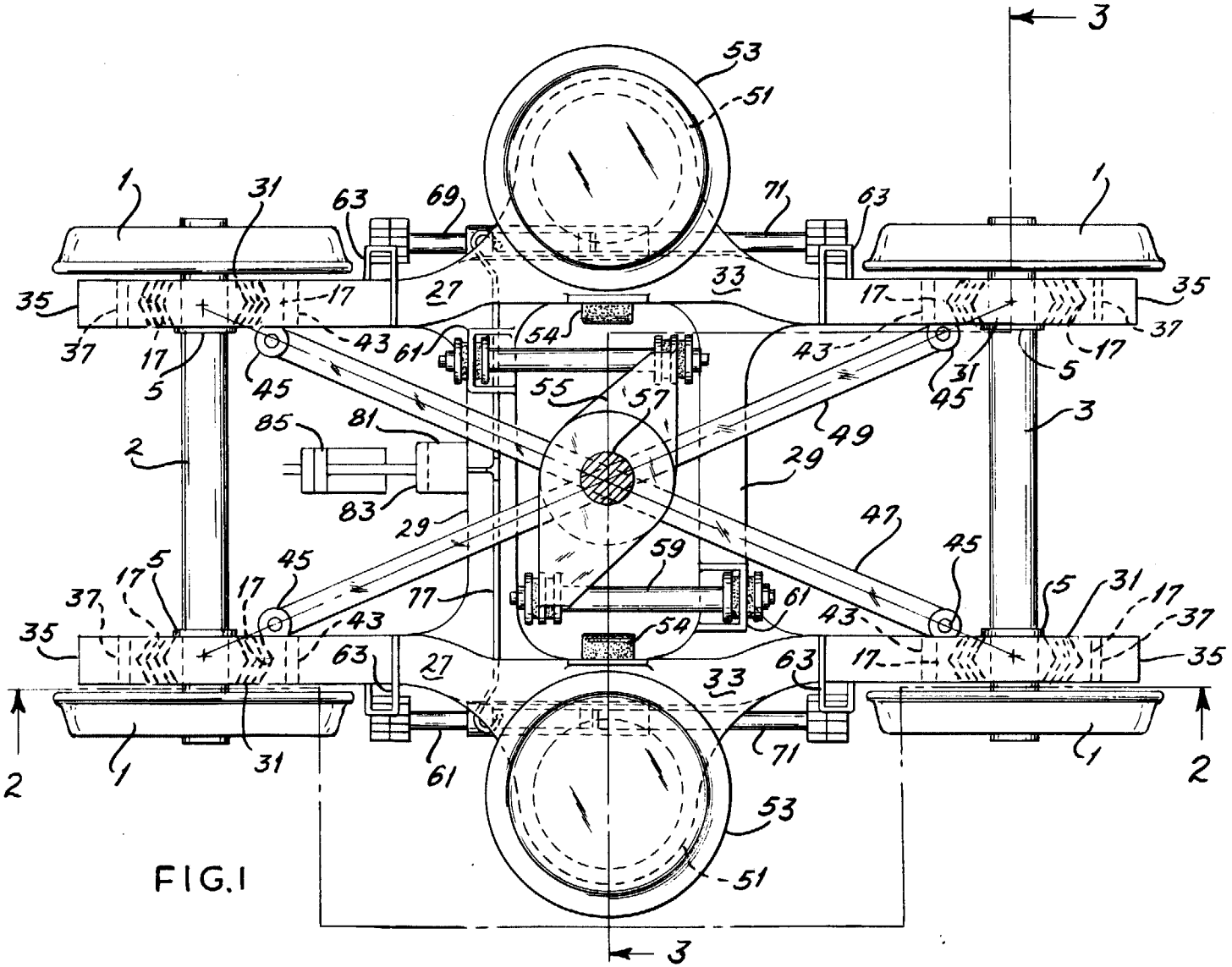
FIG. 1 is a plan view of a four wheel railway car truck embodying the invention.
Figure 2:
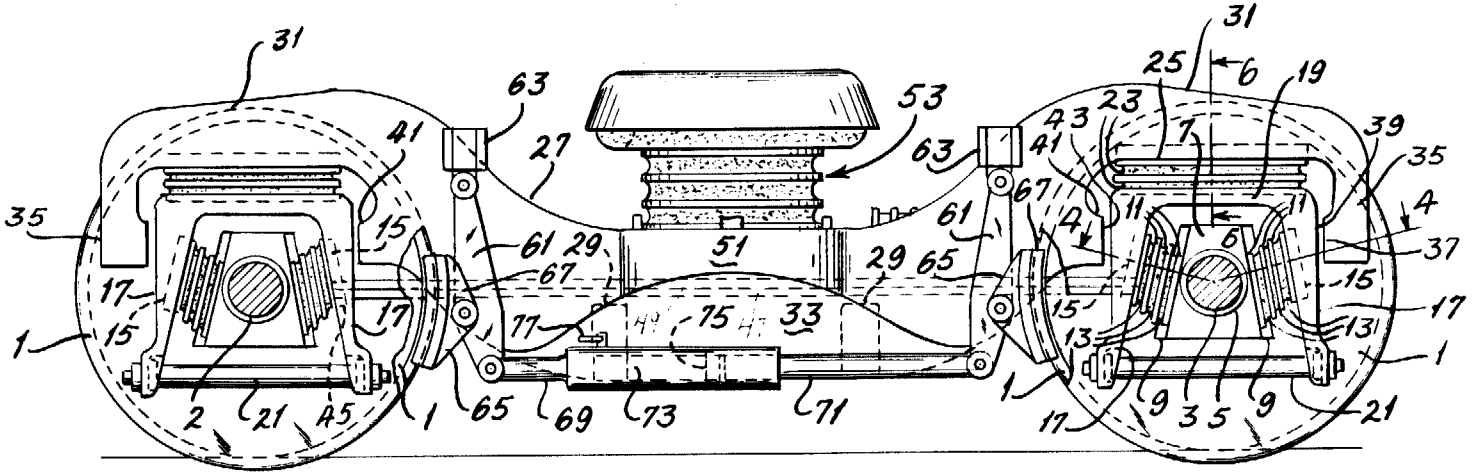
FIG. 2 is a longitudinal vertical sectional view taken along line 2—2 of FIG. 1.
Figure 4:
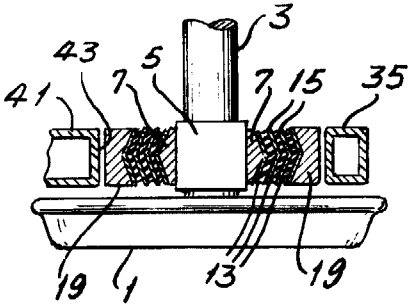
FIG. 4 is a generally horizontal sectional view taken along line 4—4 of FIG. 2.
Figure 3:
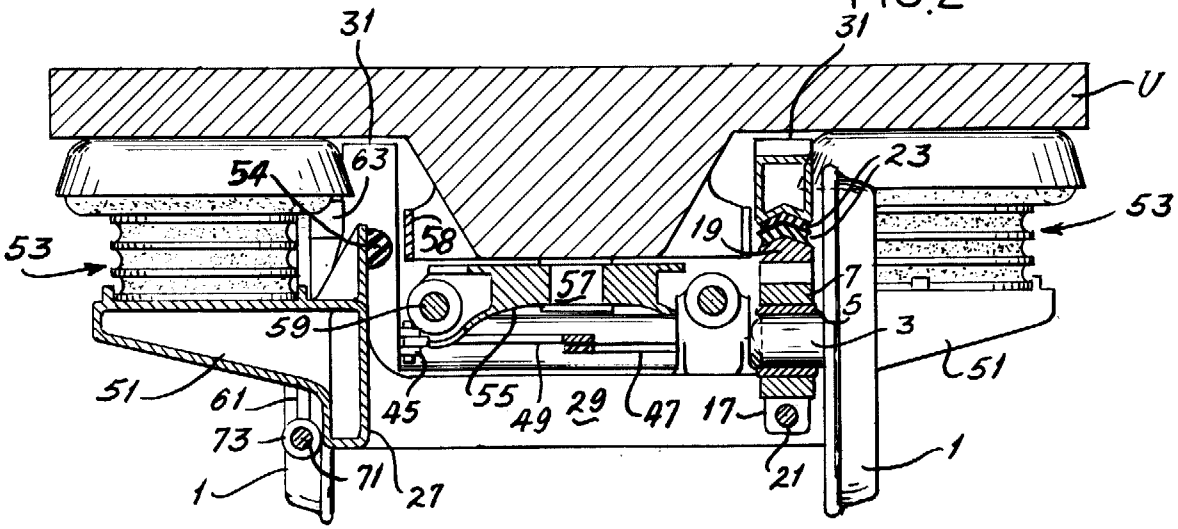
FIG. 3 is a transverse vertical sectional view taken along line 3—3 of FIG. 1.

The truck illustrated in FIGS. 1—3 has a pair of spaced wheel 1 and axle assemblies each comprising railway flanged wheels mounted in gauged pairs on the ends of the respective axles 2 and 3. The effective conicity of the wheel tread profiles is sufficient to effect self-steering of each wheel and axle assembly by means of the differential effect between the wheel diameters of the outer and inner wheels on curved track and is substantially greater than the standard conicity of 1:20 or 0.05, preferably being between 1:10 and 1:5. Inboard of the wheels, each of the axles 2 and 3 mounts, adjacent each wheel, an axle bearing 5 on which is mounted an adapter 7 of generally isosceles trapezoidal shape in elevation, the fore and aft surfaces 9 of each adapter 7 being V-shape in plan with their apices pointing away from the associated bearings. Correspondingly V-shaped elastomeric pad devices comprising metal plates 11 bonded to similarly shaped elastomeric pads 13 are secured to fore and aft surfaces 9 of adapter member 7 and their outermost plates 11 are secured to inner surfaces 15 of spaced vertical legs 17 connected by horizontal top members 19 to form downwardly open yokes, surfaces 15 being inclined parallel respectively to fore and aft surfaces 9 of the adapters and being of corresponding concave V-shape in plan. Preferably the lower extremities of yoke legs 17 are connected by a binder or tie bolt 21 to oppose any tendencies toward spreading. The top member 19 of each yoke is of convex V-shape with its apex longitudinal of the truck and mounts a V-section elastomeric sandwich device with its apex somewhat elongated lengthwise of the truck and comprising a pair of flat elastomeric pads 23 bonded on their respective top and bottom surfaces by flat metal plates 25.

A rigid truck frame, comprising longitudinally extending transversely spaced side members 27 positioned generally transversely inwardly of wheels 1 and connected by a pair of longitudinally spaced transversely extending transom members 29, symmetrically disposed fore and aft of the transverse center line of the truck, is supported at the end portions 31 of side members 27 on elastomeric sandwich devices 23, 25, the lower surfaces of the end portions of frame side member 27 being correspondingly of concave V-shape and arranged for securement to top plate 25 of the sandwich devices. In order to minimize the overall height of the truck, the central portion 33 of each of the side members 27 is depressed to a substantially lower level than the end portions 31.

With the truck structure as thus far described, it will be evident that yokes 17, 19 will be vertically resiliently supported on adapters 7 by reason of the yieldability in vertical shear of elastomeric pad devices 11, 13 but that relative longitudinal and lateral movements of the yokes relative to the axle bearing adapter 7 will be effectively resisted by the resistance of the elastomeric pad devices 11, 13 to compression transversely and longitudinally of the truck. However, limited movement of the yokes 17, 19 longitudinally of the truck sufficient to accommodate limited yaw of axles 2 and 3 with respect to truck frame 27—33 will be accommodated by yielding in shear of elastomeric sandwich devices 23, 25 longitudinally of the truck and lateral movements opposed by the resistance of pads 23 to compression transversely of the truck.

For preventing excessive movement of the axles, longitudinally of the truck, the end portions 31 of truck frame side members are bent downwardly at 35 longitudinally outboard of the respective yokes 17, 19 and are formed at their lower extremities with vertical safety stop surfaces 37 spaced from outer legs 17 longitudinally of the truck but engageable with opposed vertical surfaces 39 on the outer legs 17 of the respective yokes. Longitudinally inboard of the truck from the respective yokes, the truck frame is formed with brackets 41 having similarly vertical safety stop surfaces 43 in similarly spaced opposing relation with longitudinally inboard vertical surface 39 of inboard yoke legs 17.

Substantially at axle level, inboard legs 17 of the yoke are formed with inwardly extending clevis-like brackets 45 and the diagonally opposed brackets 45 are connected by diagonal links 47, 49 the ends of which are pivotally secured to the respective brackets 45. Diagonal links 47, 49 couple the wheel induced steering movements of the individual wheel and axle assemblies to cause their symmetrical turning movements in opposite directions on curved track and cooperate with the resistance offered by the longitudinally acting pads 23 to oppose hunting movements of the wheel and axle assemblies on tangent track.

For supporting vehicle body underframe U and accommodating swivel movements of the truck with respect thereto and lateral movements of the underframe with respect to the truck so as to cushion the body from transverse irregularities in the track structure, depressed central portions 33 of frame side members 27 are extended transversely outboard at 51 to form brackets for supporting upright spring devices generally indicated at 53 constructed to yield vertically and in longitudinal and lateral shear for accommodating vertical cushioning, swivel and lateral cushioning movements of the supported underframe U with respect to the truck.

For resiliently limiting lateral movements of underframe U on the truck, laterally inwardly facing elastomeric bumpers 54 are mounted on upstanding brackets 56 on the central portions of the frame side members 27 and oppose, in spaced relation, depending brackets 58 on underframe U.

For transmitting traction and braking forces between the truck and underframe, a Watts linkage comprising a generally transverse lever 55 fulcrumed at the center of the truck on a pin 57 depending from underframe U and connected at its ends by longitudinally extending anchor devices 59 to upstanding brackets 61 on the truck frame transoms 29 is provided.

For braking the truck irrespective of axle yaw, the brake rigging at each side comprises a pair of substantially vertical brake levers 61 pivotally depending from outboard brackets 63 on the truck frame side members 29 and pivotally mounting intermediate their ends brake heads 65 carrying the usual shoes 67 engageable with the adjacent wheel treads. At their lower ends levers 61 are connected respectively to a pair of aligned rods 69 and 71 extending longitudinally of the truck, rod 69 mounting a hydraulic cylinder 73 and rod 71 being connected to a piston 75 in cylinder 73. The cylinders 73 on opposite sides of the truck are connected by a transverse hydraulic conduit 77 communicating via a tee connection 79 with a master cylinder 81, the piston 83 of which is actuated by the power brake system on the car, e.g. air brake cylinder 85. Because of the interconnection by means of conduit 77 of the hydraulic cylinders at each side, the brakes at both sides will be equalized irrespective of yaw of the axles on curved track when the wheel treads on the inside of the curve would be substantially closer to each other than those on the outside of the curves and thus even under such yaw conditions in which the axles are substantially radial of the curve, equal brake pressure would be applied to each wheel tread.

Operation of the truck incorporating the invention is as follows: While moving along tangent track, all tendencies of the individual axles to oscillate about vertical axes or to move lengthwise with respect to the truck frame, are resisted by the resistance of elastomeric pads 23 to shear longitudinally of the truck and are limited by stops 37 and 43 in co-operation with the outer vertical surfaces of yoke legs 17, and diagonal links 47 and 49 co-operate with the resistance offered by elastomeric pads 23 to oppose any such oscillation or hunting movements of the individual axles. In the absence of such movements by the individual axles, the truck frame is similarly insulted against such oscillations or hunting movements, making unnecessary the provision of damping means between the truck frame and the supported car body underframe, thus facilitating the use of the bolsterless construction of the type disclosed, in which the underframe is supported on the truck frame by combination pneumatic and elastomeric spring devices yieldable vertically, laterally and longitudinally to accommodate relative cushioning and swiveling movements of the body and the draft connection between the body and the truck frame can consist of a device such as the disclosed Watts linkage which offers complete freedom of movement vertically and laterally and in swivel, but not longitudinally so as to form a substantially unyielding draft connection between the truck and body. As the truck moves along curved track, the conically profiled wheel treads, by reason of the engagement of different diameters of the inner and outer wheel treads with the respective track rails, induce self-steering swiveling movements in the individual wheel and axle assemblies, which are thereby positioned substantially radially with respect to the track curvature. The coupling of the wheel and axle assemblies to each other accommodates symmetrical swiveling movements in opposite senses of the individual wheel and axle assemblies and thus avoids interference with the self-steering capability of the respective wheel and axle assemblies on curved track, but damps hunting tendencies and counteracts hunting of the wheel and axle assemblies by causing swiveling movements of either wheel and axle assembly to produce opposite swiveling movements of the other wheel and axle assembly as the truck moves along tangent track. As the truck moves from curved to tangent track, the interconnecting links assist the self-steering capacity of the axles and elastomeric pad devices 23, 25 to restore the axles to their normal tangent track positions and maintain them therein. By reason of the inboard location of the longitudinally acting axle restraint devices, i.e., elastomeric pad devices 23, 25 the resistance they offer to movement of the axles purely longitudinally of the truck frame is just as great as if pads of equal stiffness were positioned laterally outboard of the wheels but the resistance that the elastomeric pad devices at opposite sides of the truck offer to steering yaw movements of the axles is advantageously minimized by virtue of their close spacing transversly of the truck and the consequent shortening of the transverse arm through which they act as a couple to oppose yaw.

When the brakes are actuated, for example by applying air to the air cylinder 85 and thereby actuating piston 83 of hydraulic master cylinder 81, due to the interconnection between the brake cylinders at opposite sides of the truck the pressure in each cylinder will be equalized, causing the brake shoes 67 to be applied with equal force to the wheel treads irrespective of differences in the longitudinal spacing of the wheels at the opposite sides of the truck when the truck is operating on curved track.

Figure 5:
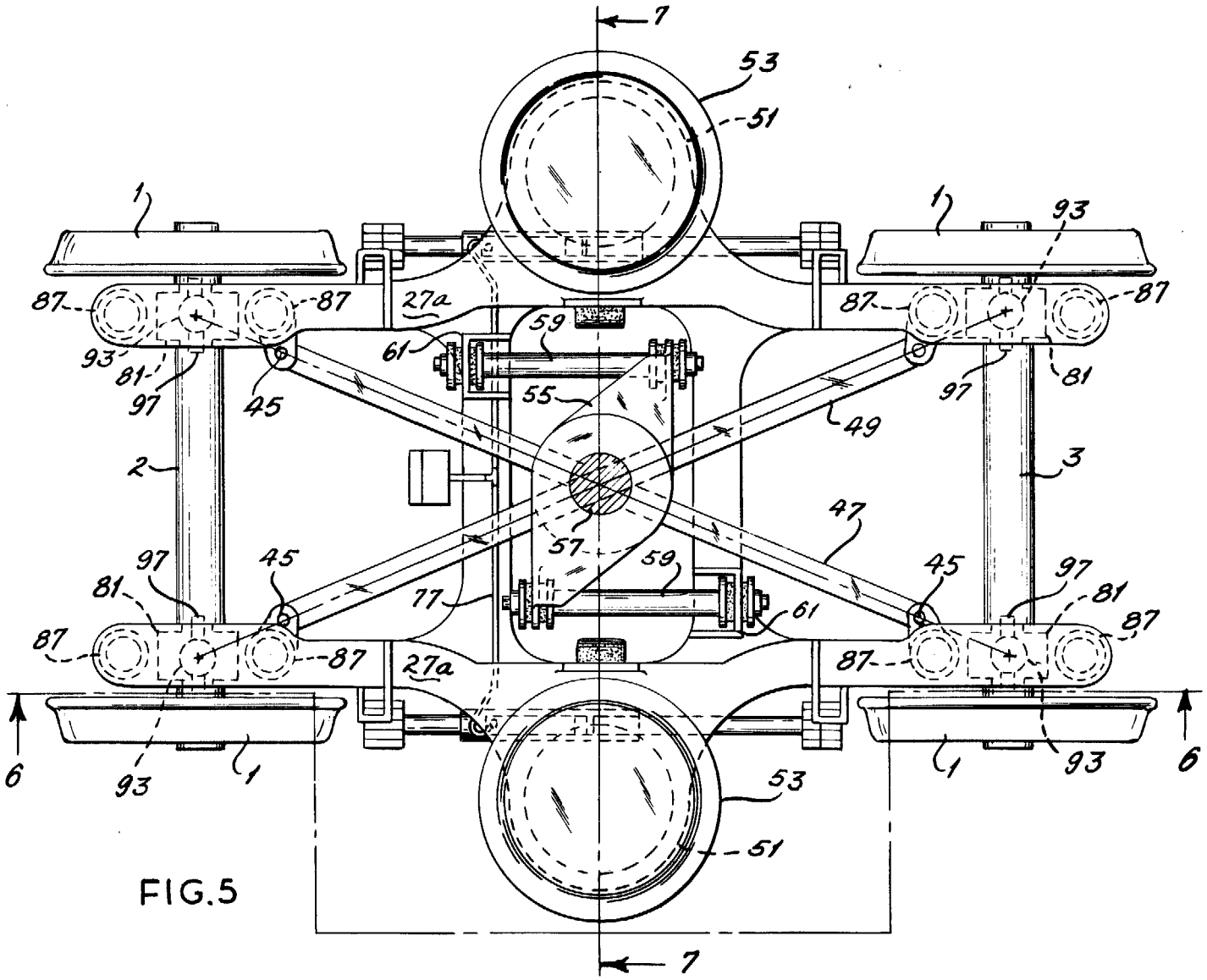
FIG. 5 is a plan view of a modified form of the truck embodying the invention.
Figure 6:
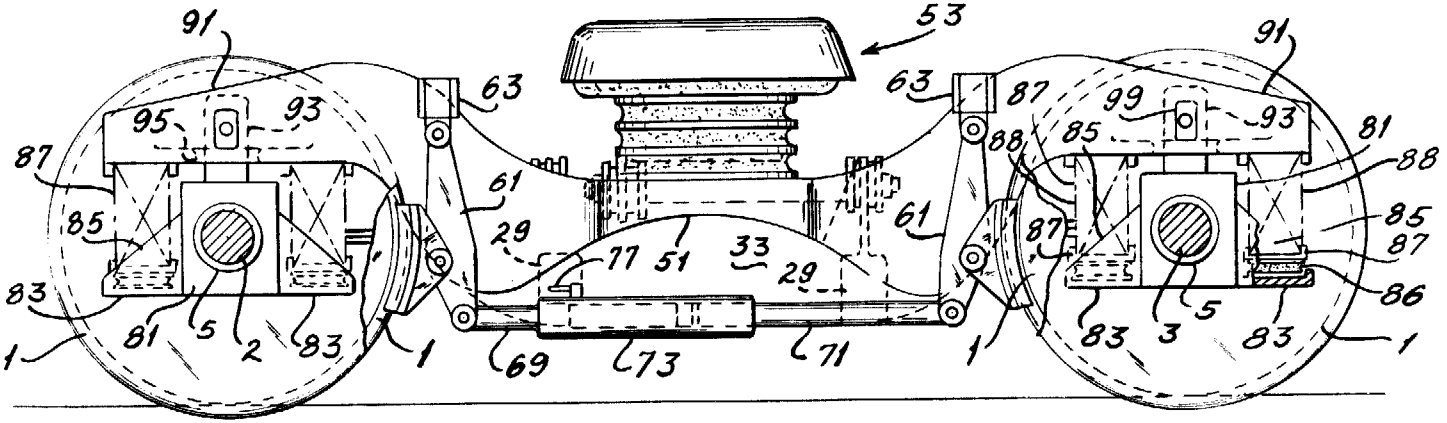
FIG. 6 is a longitudinal vertical sectional view taken along line 6—6 of FIG. 5.
Figure 7:
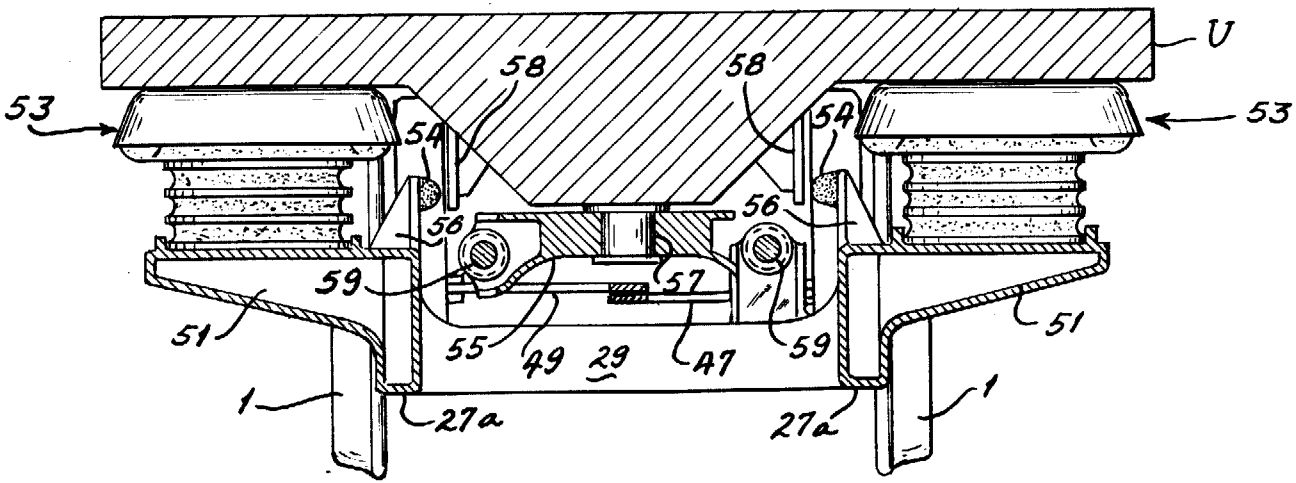
FIG. 7 is a transverse vertical sectional view taken along line 7—7 of FIG. 5.

In FIGS. 5–7 the same numerals as are used in FIGS. 1–3 are used to denote identical or substantially identical elements, the principal difference between the truck of the first embodiment and that of FIGS. 5–7 being in the primary suspension whereby the truck frame is supported from the axles. In this embodiment, the axle bearings 5 are each respectively mounted in a rectangular adapter 80 formed with fore and aft shelves or wings 82 supported by appropriate gussets 84 and mounting upright spring means comprising flat elastomeric pad devices 86 seated on wings 82 and supporting spring seats 87 carrying coil springs 88, which underlyingly engage the bottom surfaces of end portions 91 of the truck frame side members 27*a*, vertical movements of the frame with respect to the axles and yawing movements of the axles with respect to the truck frame being accommodated and yieldingly resisted respectively by the capacity of spring means 86–88 to yield vertically and in horizontal shear and the resistance of the spring means 86–88 to vertical and shear horizontal deflections, damping of such movements being accomplished by reason of hysteresis in elastomeric pad devices 86.

For preventing separation of the truck frame from the axle bearings while permitting the vertical and yaw movements accommodated by spring means 86–88, journal bearing adapters 81 are formed with upwardly extending stems 93 which pass through slightly larger openings 95 in the bottom wall of the box section truck frame end portions 91 and a transversely extending removable pin 97 extends through upstanding stems 93 and projects outwardly through generally rectangular vertically elongated openings 99 in the side walls of the box section end portions 91 of the truck frame side members 72*a*.

Except for the fact that resistance to yaw and longitudinal movement of the axle and damping of axle yaw movement is provided by resistance of spring means 86–88 to deflection is shear longitudinally of the truck and by the damping characteristics of the elastomeric pads 86, operation of the truck of FIGS. 5–7 is identical to that of the first embodiment, in which vertical cushioning of the truck frame and vertical damping is provided by the vertical resiliency of V-shaped elastomeric sandwich devices 11, 13 and resistance to yaw and longitudinal movement of the axle bearings and damping of axle yaw movements is provided by resistance in flat elastomeric sandwich devices 23, 25 to shear lengthwise of the truck and the damping characteristics of the elastomeric devices.

Figure 8:
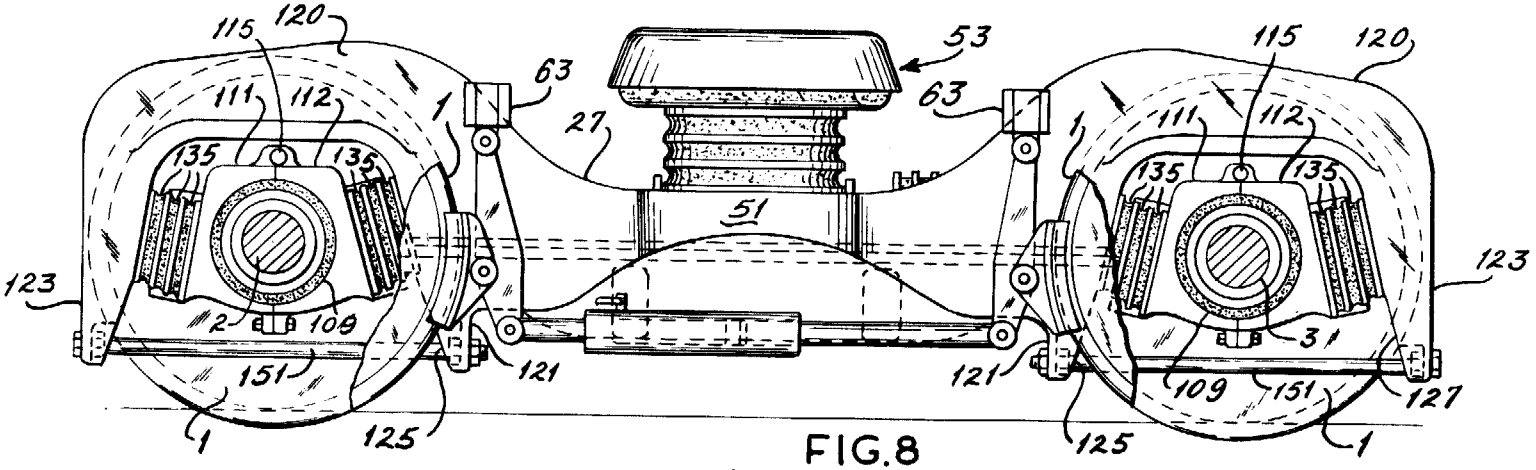
FIG. 8 is a side elevational view, partially sectionalized similarly to FIGS. 2 and 6, of a truck embodying a third form of the invention.
Figure 10:
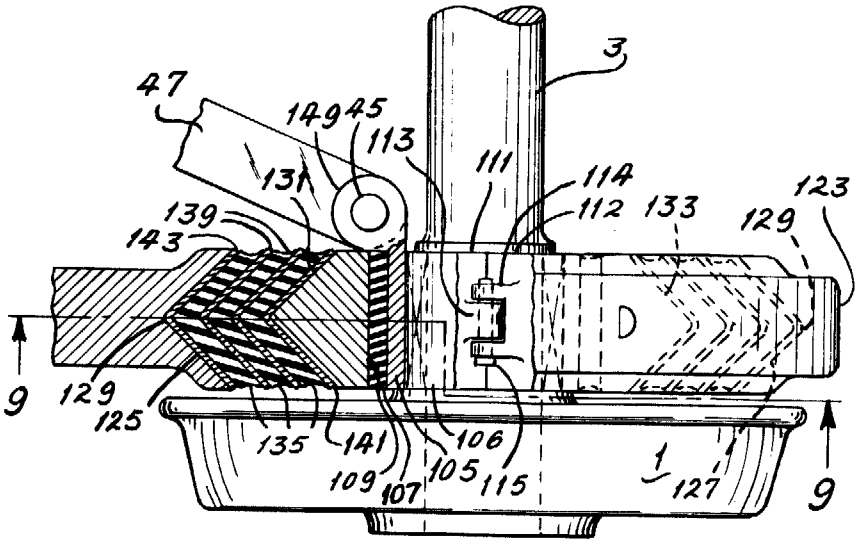
FIG. 10 is an enlarged top view partially sectionalized along line 10—10 of FIG. 9.
Figure 9:
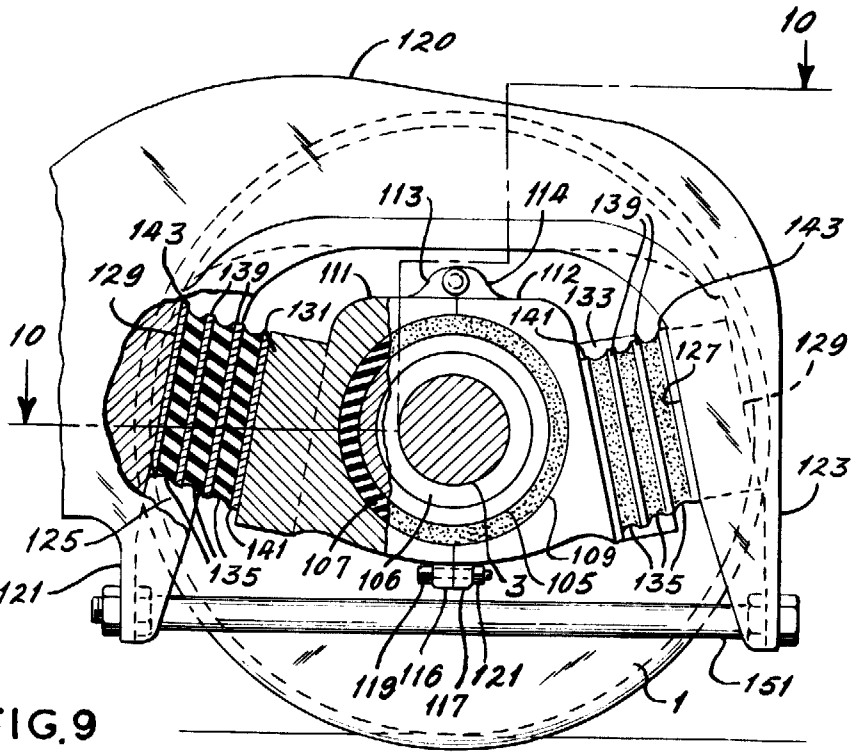
FIG. 9 is an enlarged fragmentary elevational view, partially sectionalized along line 9—9 of FIG. 10, of a pedestal and the associated primary suspension arrangement of the truck illustrated in FIG. 8.

In the embodiment of FIGS. 8–10, the same numerals as are used in FIGS. 1–7 are used to denote identical or substantially identical elements, the principal difference between the trucks of the embodiments of FIGS. 1–4 and 5–7 and the embodiment of FIGS. 8–10 being in the primary suspension whereby the truck frame is supported from the axles. In the truck of FIGS. 8–10 the housings 105 of journal bearings 106 are of cylindrical shape and are surrounded by an elastomeric grommet 107 which is clamped between semi-cylindrical apertures 109 in the vertically divided journal bearing adapter halves 111 and 112. Journal bearing adapter havles 111 and 112 are formed at their tops with hinge pin bearing members 113 and 114 through which a hinge pin 115 extends to permit opening up the adapter 111, 112 for insertion and removal of grommets 107 and journal bearing housings 105. On their lower surfaces, adapter halves 111 and 112 are formed with depending bosses 116 and 117 with aligned holes receiving a bolt 119 by which the journal bearing adapter halves are secured to each other in abutting assembled relation by means of a nut 121 on bolt 119.

With this arrangement of the journal bearings and their housings 105, the surrounding grommets 107 and the journal bearing adapter structure 111, 112 thus described, it will be evident that the axle 1 or 3 will be capable of movement transversely of the truck with respect to the journal bearing adapters 111 and 112 to the extent that the elastomeric material of grommet 107 is yieldable in shear.

To support the truck frame from the journal bearing adapters 111, 112, the truck frame end portions 120 are formed with downwardly open pedestal jaws defined by depending pedestal legs 121 and 123 spaced apart longitudinally of the truck a substantially greater distance than the maximum dimension longitudinally of the truck of axle bearing adapters 111, 112, and their inner surfaces 125 and 127 respectively are symmetrically inclined slightly toward each other upwardly in a direction longitudinally of the truck and are of concave V-shape with their apices 129 pointing away from the respective axle. The outer transverse surfaces 131 and 133 respectively of journal bearing adapter halves 111 and 112 are similarly inclined substantially parallel respectively to pedestal surfaces 125 and 127 and are of similar, though convex, V-shaped cross section. Interposed between the opposed V-shaped surfaces 125, 131 and 127, 133 are multi-layer sandwich devices of chevron shape in plan, each consisting of three V-shaped elastomeric pads 135 interleaved by V-shaped metal plates 139 and bounded by V-shaped metal boundary plates 141 and 143. Elastomeric pads 135 are bonded to the adjacent metal plates 135, 141, and 143, and inner boundary plates 141 are secured to the outer V-shaped surfaces 131 and 133 of the axle bearing adapter halves 111 and 112, and the outer boundary plates 143 of the elastomeric sandwich devices are secured to V-shaped surfaces 125 and 127 respectively of the pedestal legs, such that the truck frame is supported on the axle bearing housings 111 and 112 by the resistance to shear and compression vertically of elastomeric pads 135, vertical cushioning of the truck frame being provided by the yieldability, principally in shear vertically, of the elastomeric pads 135. The sandwich devices 135, 139, 141, 143, the mounting surfaces 131 and 133 of journal bearing adapters 111, 112, and the mounting surfaces 125 and 127 of pedestals 121 and 123 are sharply angled, preferably in the order of 90°, as compared with the corresponding obtusely-angled surfaces in the first embodiment (FIG. 4), such that elastomeric pads 135 are relatively yieldable longitudinally of the truck due to their relatively large shear component and relatively small compression component lengthwise of the truck as compared with pads 13 of the first embodiment, thus accommodating substantial movement lengthwise of the truck of the respective axle journal portions and eliminating the need for additional means such as sandwich devices 23, 25 of the first embodiment to accommodate such longitudinal movement of the axle ends as is required for radial movements of the axles on curved track. Inasmuch as the chevron sandwich devices of this relatively acute angular configuration provide substantially greater resistance through compression transversely of the truck than is provided by the obtusely angled chevrons of the first embodiment, movements of the axles transversely of the truck, required for radiation of the axles on curved track and to cushion the truck frame from impact due to transverse irregularities in the truck rails, are accommodated by shear in elastomeric grommets 109 in a direction transverse of the truck.

To oppose any tendencies of pedestal legs 121 and 123 to spread apart due to the longitudinal components of the load applied through chevron devices 135, 139, 141, 143, the lower ends of the pedestal legs are secured to each other by tie bolts 151.

The resultant structure is substantially simpler and less expensive than the first embodiment and is equally effective in accommodating the slight longitudinal and transverse movements of the axle bearings required for radial positioning of the axles during movement on curved track.

Preferably the diagonal links 47 and 49, if used, are pivotally connected at 45 to brackets 149 extending inwardly from the axle bearing housings 105.

It will be evident from the description of the embodiment of FIGS. 8–10 that when steering forces are applied to the axles as a result of the differential effect of the high conicity treads of the inner and outer wheels, the journal portions of the axles and their surrounding bearings and bearing housings 105 will be permitted to move longitudinally in the pedestal jaws by reason of the relatively sharp angular configuration of the chevron pad devices with their consequent large shear components and relatively small compression components lengthwise of the truck and shear in grommets 109 between journal bearing housings 105 and journal bearing adapters 111, 112 will permit the necessary movement of the axles transverse of the truck, compensating for the transverse stiffness of the chevron devices resulting from their relatively high compression component transversely of the truck. Impacts received by the wheel and axle assemblies from transverse irregularities in the truck rails are absorbed by shear in grommets 107 which thereby cushion the truck frame from such impacts.

The details of the trucks described herein may be varied substantially without departing from the spirit of the invention and the exclusive use of such modifications as come within the scope of the appended claims is contemplated.

I claim:

1. A railway truck comprising a pair of wheel and axle assemblies each having a pair of railway flanged wheels rigidly mounted on the ends of an axle, said axles being capable of pivoting about a vertical axis between positions transverse of the truck on tangent track and positions radial of the track on curved track, said wheels having a profiled tread of sufficient effective conicity to effect self-steering of each wheel and axle assembly by means of the differential effect between the wheel diameters of the outer and inner wheels on curved track, a rigid truck frame supported from said wheel and axle assemblies, resilient means supporting said truck frame and including supports carried on the end portions of said axles, said resilient means including elastomeric elements positioned between the respective end portions of said axles and said truck frame, and being yieldable longitudinally of the truck to accommodate, restrain and dampen movements of the respective end portions of each wheel and axle assembly longitudinally of the truck and pivoting movements of said wheel and axle assemblies and being sufficiently yieldable vertically to accommodate vertical movements of the respective end portions of each wheel and axle assembly with respect to said truck frame necessitated for proper distribution of the vertical load to the wheels irrespective of vertical track irregularities while being sufficiently stiff vertically to bear the entire vertical load of the truck, said resilient means being located inboard of said wheels thereby defining short transverse moment arms through which said resilient means act on each axle as a couple in opposing pivoting movements of the respective wheel and axle assemblies whereby to offer less restraint to such pivoting movements than the steering torques generated by the differential effect of said profiled wheel treads on curved track, and means interconnecting said wheel the resilient means supports on the respective axles substantially at axle level to cause said wheel and axle assemblies to pivot in opposite senses and co-operating with the longitudinal action of said resilient means to oppose hunting movements of the wheel and axle assemblies while coupling their wheel-induced steering movements to avoid interference with the self-steering capability of each wheel and axle assembly on curved track.

2. A railway truck according to claim 1 having a brake system comprising substantially upright levers pivotally suspended from the sides of said truck frame adjacent the wheels at each side thereof, brake shoes carried by said levers and engageable with the respective wheel treads responsive to longitudinal separation of said levers, an extensible rod device connecting the lower end portions of said levers and including a cylinder connected to one of said levers and a piston therein connected to the other of said levers, and a hydraulic fluid interconnection between said cylinders at opposite sides of the truck whereby to positively equalize braking pressure on the separate brake shoes on both sides irrespective of variations in the longitudinal spacing of the wheels on the opposite sides of the truck resulting from steering action of said wheel and axle assemblies.

3. A railway truck according to claim 1, wherein said interconnecting means comprises rigid links pivotally connected at their opposite ends to the diagonally opposite end portions of the respective wheel and axle assemblies.

4. A railway truck according to claim 1 wherein said resilient means supports axle bearing means on the end portions of each axle inboard of the respective wheels, said truck frame having portions inboard of said wheels and overlying said axle bearing means, and said resilient means being interposed between said axle bearing means and said overlying truck frame portions.

5. A railway truck according to claim 4, wherein said truck frame portions overlying said axle bearings comprise the side members of said truck frame.

6. A railway truck according to claim 4, wherein said interconnecting means comprises rigid substantially straight links connected at their opposite ends to the diagonally opposite axle bearing means with their axial projections substantially intersecting the centers of said axle bearing means.

7. A railway truck according to claim 4, wherein each said resilient supporting means comprises upwardly converging fore and aft surfaces on said axle bearing means, each of said surfaces being V-shaped in plan and mounting similarly shaped elastomeric pad devices, there being a yoke element having its sides similarly upwardly converging to said bearing means surfaces and correspondingly shaped in plan, said elastomeric pad devices being secured to said yoke converging surfaces whereby to resiliently support said yoke from the respective axle bearing means vertically and substantially fix said yoke longitudinally and transversely with respect to said axle bearing means, said yoke having upwardly facing horizontal surface means and opposing horizontal surface means on the overlying truck frame portions, said elastomeric elements comprising horizontal elastomeric pad devices interposed between and fixed to said opposing horizontal surfaces of said yoke and said overlying truck framing portions, whereby to accommodate and yieldingly resist longitudinal and yawing movements of the respective wheel and axle assemblies with respect to said truck frame.

8. A railway truck according to claim 7, wherein said interconnecting means are rigid links pivotally connected at their opposite ends to the diagonally opposite yokes.

9. A railway truck according to claim 8, wherein said links are substantially straight and their pivotal connections to said yokes are so positioned that their axial projections intersect the centers of said bearing means.

10. A railway truck according to claim 4, wherein said resilient supporting means comprises spring seats carried by said bearing means and upright spring means seated on said spring seats and underlyingly engaging downwardly facing spring cap means on the overlying portions of said frame side members, resistance to longitudinal and yawing movements of said wheel and axle assemblies being provided by the resistance of said upright spring means to deflection in shear longitudinally of the truck.

11. A railway truck according to claim 10, wherein said diagonal interconnecting means are rigid links pivotally connected at their opposite ends to diagonally opposite spring seats.

12. A railway truck according to claim 10, wherein said upright spring means include said elastomeric elements, comprising elastomeric members yieldable in shear longitudinally of the truck.

13. A railway truck according to claim 1 including transversely spaced upright spring devices fixedly supported on said truck frame intermediate said wheel and axle assemblies and adapted for underlying securement to a supported vehicle body, said spring devices being yieldable vertically, and transversely and longitudinally horizontally to provide vertical and lateral cushioning and truck swivel, and a longitudinal force-transmitting device connected to said truck frame and adapted for connection to a supported vehicle body for holding said truck frame against movement longitudinally of the body while accommodating lateral, vertical and swivel movements of the body and truck frame with respect to each other.

14. A railway truck according to claim 13, wherein said truck frame has transversely spaced longitudinally extending side members and longitudinally spaced transversely extending transoms rigidly connecting said frame side members intermediate said axles, said side members being formed with outwardly extending brackets forming seats for said upright springs.

15. A railway truck according to claim 14, wherein said longitudinal force-transmitting connection comprises a Watts linkage connected to said truck frame transom structure and adapted for connection to a supported vehicle body.

16. A railway truck according to claim 15, wherein said Watts linkage comprises a generally transversely extending lever adapted to be fulcrumed on a supported vehicle body at the normal center of the truck on a vertical axis and a pair of links extending longitudinally of the truck and pivotally connected at their one ends to the ends of said lever and at their other ends to the respective transoms.

17. A railway truck according to claim 1, wherein each said resilient means comprises an annular grommet of elastomeric material surrounding said axle bearing means, a rigid element surrounding said grommet and clamped around the same, said rigid element having upwardly converging fore and aft surfaces, each of said surfaces being V-shaped in plan and mounting said elastomeric elements, comprising similarly shaped elastomeric pad devices, said truck framing having downwardly open pedestal jaws at each of its ends with their inner ends similarly inclined and complementarily V-shaped in plan to said pad devices, said pad devices being secured to said pedestal jaw surfaces whereby to resiliently support the respective ends of said truck framing from the respective axle bearing means vertically, the angle of each said pad device being sufficiently acute that said pad devices are yieldable substantially lengthwise and are relatively stiff transversely of the truck and said elastomeric grommet being substantially yieldable transversely and stiff longitudinally of the truck whereby to co-operate with said pad devices to accommodate and yieldingly resist yawing movements of the respective wheel and axle assemblies with respect to said truck frame.

18. A railway truck according to claim 17, wherein said interconnecting means comprises rigid links pivotally connected at their opposite ends to the diagonally opposite axle bearing means.

19. A railway truck according to claim 18, wherein said axle bearing means includes a peripheral housing and said rigid links are pivotally connected directly thereto.

20. In a railway truck comprising a pair of wheel and axle assemblies each having a pair of railway flanged wheels rigidly mounted on the ends of an axle, truck framing supported from said wheel and axle assemblies and accommodating relative turning movements of said wheel and axle assemblies in the horizontal plane for steering, said wheel and axle assemblies having steering means causing them to pivot in opposite senses on curved track, a brake system comprising substantially upright levers pivotally suspended from the sides of said truck framing adjacent said wheels at each side thereof, brake shoes carried by said levers and engageable with the respective wheel treads responsive to longitudinal separation of said levers, an extensible rod device connecting said levers at each side and comprising a longitudinally extending cylinder and piston assembly connected at its respective ends to said levers, said levers forming the sole support of said cylinder and piston assembly from the truck framing and a hydraulic fluid interconnection between said cylinders at opposite sides of the truck whereby to positively equalize braking pressure on the separate brake shoes on both sides irrespective of differences in the longitudinal spacing of the wheels on the opposite sides of the truck resulting from steering action of said wheel and axle assemblies.

21. In a railway truck comprising a pair of wheel and axle assemblies each having a pair of railway flanged wheels rigidly mounted on the ends of an axle and axle bearings on the end portions of each axle, a rigid truck frame supported from said wheel and axle assemblies, resilient means supporting said frame from said axle bearing means to permit steering movements of said wheel and axle assemblies with respect to said frame, said wheel and axle assemblies having steering means causing them to pivot in opposite senses on curved track, said resilient means comprising upwardly converging fore and aft surfaces on each said axle bearing means, each of said surfaces being V-shaped in plan and mounting similarly shaped elastomeric pad devices, a yoke element having its sides upwardly converging similarly to said bearing means surfaces and correspondingly V-shaped in plan, said elastomeric pad devices being secured to said yoke converging surfaces whereby to resiliently support said yoke from the respective axle bearing means vertically and being substantially yieldable in shear vertically and transversely to accommodate substantial vertical movement of the respective bearing means with respect to said rigid truck frame as required for proper distribution of the vertical load from said rigid frame to the respective wheels irrespective of vertical irregularities in the track rails and to provide a transverse component for steering movements of said wheel and axle assemblies, said V-shaped pad devices being stiff longitudinally of the truck whereby to substantially fix said yoke longitudinally with respect to said bearing means, said yoke having upwardly facing horizontal surface means and opposing horizontal surface means on said truck frame, and horizontally oriented elastomeric pad devices interposed between and fixed to said opposing horizontal surfaces of said yoke and said truck frame and being yieldable in shear longitudinally of the truck whereby to accommodate the longitudinal component of steering movements of the respective wheel and axle assemblies with respect to said truck frame.

22. In a railway truck comprising a pair of wheel and axle assemblies, each having a pair of railway flanged wheels rigidly mounted on the ends of an axle and journal bearings on the end portions of each said axle, a truck frame supported from said wheel and axle assemblies and accommodating relative yawing thereof for steering, resilient means supporting said frame from said journal bearing means and comprising an annular grommet of elastomeric material surrounding said axle bearing means, a rigid element surrounding said grommet and clamped around the same, said rigid element having upwardly converging fore and aft surfaces, each of said surfaces being V-shaped in plan and mounting similarly shaped elastomeric pad devices, said truck frame having downwardly open pedestal jaws at each of its ends with their inner jaw surfaces similarly inclined and complementarily V-shaped in plan to said pad devices, said elastomeric pad devices being secured to said pedestal jaw surfaces whereby to resiliently support the respective ends of said truck frame from the respective axle bearing means vertically, the V-shape angle of said pad devices being sufficiently acute that said pad devices are yieldable substantially lengthwise to accommodate longitudinal components of said yawing movements and are relatively stiff transversely of the truck and said elastomeric grommet being substantially yieldable transversely of the truck whereby to provide transverse components of said yawing movements and co-operate with said pad devices to accommodate and yieldingly resist yawing movements of the respective wheel and axle assemblies with respect to said truck frame.

* * * * *